US006939139B2

(12) United States Patent
Götz et al.

(10) Patent No.: US 6,939,139 B2
(45) Date of Patent: Sep. 6, 2005

(54) DEVICE FOR CONNECTING A UNIT WITH A CONNECTION TERMINAL TO A SUPPORT

(75) Inventors: Knuth Götz, Mistelbach (DE); Gerhard Reichinger, Redinitzhembach (DE)

(73) Assignee: Leoni AG, Nuremberg (DE)

( * ) Notice: Subject to any disclaimer, the term of this patent is extended or adjusted under 35 U.S.C. 154(b) by 0 days.

(21) Appl. No.: 10/913,562

(22) Filed: Aug. 6, 2004

(65) Prior Publication Data

US 2005/0009376 A1 Jan. 13, 2005

Related U.S. Application Data

(63) Continuation of application No. PCT/EP03/01288, filed on Feb. 10, 2003.

(30) Foreign Application Priority Data

Feb. 11, 2002 (DE) ..... 102 05 615

(51) Int. Cl.[7] ..... H01R 33/00
(52) U.S. Cl. ..... 439/34; 439/638
(58) Field of Search ..... 439/34, 638–640

(56) References Cited

U.S. PATENT DOCUMENTS 5,035,628 A 7/1991 Casciotti et al.
5,459,637 A * 10/1995 Ma et al. ..... 361/686
5,612,855 A 3/1997 Heeb et al.
5,663,542 A * 9/1997 Kohr et al. ..... 200/61.05
5,882,220 A * 3/1999 Horii et al. ..... 439/297
6,183,269 B1 2/2001 Sarkissian et al.
6,293,804 B2 * 9/2001 Smith ..... 439/66
6,461,168 B2 * 10/2002 Zeiss et al. ..... 439/60
6,478,012 B2 * 11/2002 Bender ..... 123/399
2004/0055153 A1 3/2004 Zahradnik et al.

FOREIGN PATENT DOCUMENTS

DE 91 07 945.4 9/1991
DE 44 20 698 A1 12/1995
DE 198 14 156 C1 11/1999
DE 199 33 846 A1 1/2001
DE 101 09 087 A1 10/2002
EP 0 157 976 A2 10/1985

* cited by examiner

*Primary Examiner*—Hae Moon Hyeon
(74) *Attorney, Agent, or Firm*—Laurence A. Greenberg; Werner H. Stemer; Ralph E. Locher

(57) ABSTRACT

A simple connection of a conventional electrical unit to the conductor tracks of an electric system, such as a motor vehicle electric system, is provided. The conductor tracks are directly applied to a support, for example, by flame spraying. A terminal adapter is placed, via a partial element, between the support, which is fitted with the conductor tracks, and the electrical unit to be connected. The conductor tracks are guided, inside the terminal adapter to a conventional electrical connection of the unit.

13 Claims, 1 Drawing Sheet

DEVICE FOR CONNECTING A UNIT WITH A CONNECTION TERMINAL TO A SUPPORT

CROSS-REFERENCE TO RELATED APPLICATIONS

This is a continuing application, under 35 U.S.C. § 120, of copending international application No. PCT/EP03/01288, filed Feb. 10, 2003, which designated the United States; this application also claims the priority, under 35 U.S.C. § 119, of German patent application No. 102 05 615.3, filed Feb. 11, 2002; the prior applications are herewith incorporated by reference in their entirety.

BACKGROUND OF THE INVENTION

Field of the Invention

The invention relates to a device or an apparatus having a unit formed with an electrical connection terminal and that is fixed to a support. One example of a unit of this type is the engine block of a motor vehicle or some other component which can be connected to the electrical system of the motor vehicle. Conventional vehicle electrical systems usually have a multiplicity of individual circular conductors which are routed to a plug that is then used to connect the unit, which has a connection designed such that it is complementary to the plug, to the vehicle electrical system.

Recent developments provide for individual conductor tracks of the vehicle electrical system to be applied directly to the components of the motor vehicle, for example to bodywork components or to interior paneling. Commonly assigned German published patent application 101 09 087.0, which corresponds to U.S. patent application publication US 2004/0055153 A1, describes a process for this purpose in which the conductor track is applied directly to the corresponding component by means of a thermal/kinetic application process, in particular by means of what is known as flame spraying. In the process, suitable surface pretreatment may be provided in order to define the course of the conductor track structure. In particular, the surface regions intended for the conductor track may be designed such that they are adhesive. In these regions, a copper layer is then applied as the conductor track, for example by way of flame spraying.

In order to route a conductor track of this type to a conventional connection, for example for the engine controller of an engine block, a system change from the conductor track that is applied directly to the component to a conventional wire-connected electrical contact via a plug-in connection is required.

SUMMARY OF THE INVENTION

It is accordingly an object of the invention to provide a device with a unit having an electrical terminal which overcomes the above-mentioned disadvantages of the heretofore-known devices and methods of this general type and which permits a conventional unit having an electrical connection terminal to be suitably connected to a conductor track of this type that is applied directly to the component.

With the foregoing and other objects in view there is provided, in accordance with the invention, a device, comprising:

- a support;
- a unit mounted to said support, said unit having an electrical plug;
- at least one electrical conductor track applied directly to said support;

- a terminal adapter formed with first and second parts, said first part being disposed between said support and said unit in an assembled state and making electrical contact with said conductor track, and said second part guiding said conductor track laterally along said unit to said electrical plug.

In other words, the objects of the invention are achieved according to the invention by an apparatus having a unit which has an electrical connection and is fixed to or on a support. At least one electrical conductor track is applied directly to the support. A terminal adapter is also provided, is arranged between the conductor track and the unit in the final assembled state, and makes electrical contact with the conductor track. In the terminal adapter, the conductor track is continued to the electrical connection of the unit.

The advantage of this configuration can be seen in that the change of system is made possible by the simple interposition of the terminal adapter between the unit which is to be connected and the conductor track. One of the advantages of this is that the terminal adapter can be fixed to the support at the same time as the unit is fixed, and no separate fixing is not required.

The electrical contact between the conductor track and the terminal adapter is preferably established by bracing the unit to the support. This advantageously permits simple a pressure contact since flat electrical contact is made possible between the conductor track and the terminal adapter by these components being pressed against one another. It is also possible to make contact using a contact element, for example using a contact pin, which is pressed into the conductor track.

A plurality of conductor tracks are expediently arranged on the support, and tracks each end at a contact area, in particular an enlarged contact area, electrical contact in each case being made with the terminal adapter on area the respective contact area. Each of the conductor tracks is then routed in the terminal adapter to the electrical connection of the unit, for example by means of wires.

The terminal adapter preferably comprises two parts, the first part being arranged between the support and the unit, and the conductor track in the second part being routed along the side of the unit. This configuration means that the conductor track can run to any desired points on the unit. The unit is therefore at least partially held by the adapter, thus allowing compact design and also simple assembly. For this purpose, the terminal adapter has, in particular, an L-shaped geometry as seen in cross section, the two parts forming the two limbs of the L.

The conductor track is preferably applied, such that it adheres, directly to the support by thermal spraying, for example in accordance with the process known from DE 101 09 087.0 corresponding to U.S. patent application Publication No. 2004/0055153 A1. A conductor track of this type in an vehicle electrical system can advantageously be applied, particularly even in the engine compartment, to a load-bearing bodywork component which is designed to accommodate and hold the engine block. An vehicle electrical system of this type which has been produced using a thermal spraying process can advantageously be produced very quickly and very easily, and is automatically matched to the specified geometries of the support component without difficulty. In addition, the conductor track only requires only a very small amount of space, and there is no need for complex manual laying of conventional conductors.

Other features which are considered as characteristic for the invention are set forth in the appended claims.

Although the invention is illustrated and described herein as embodied in an apparatus having a unit which has an electrical connection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
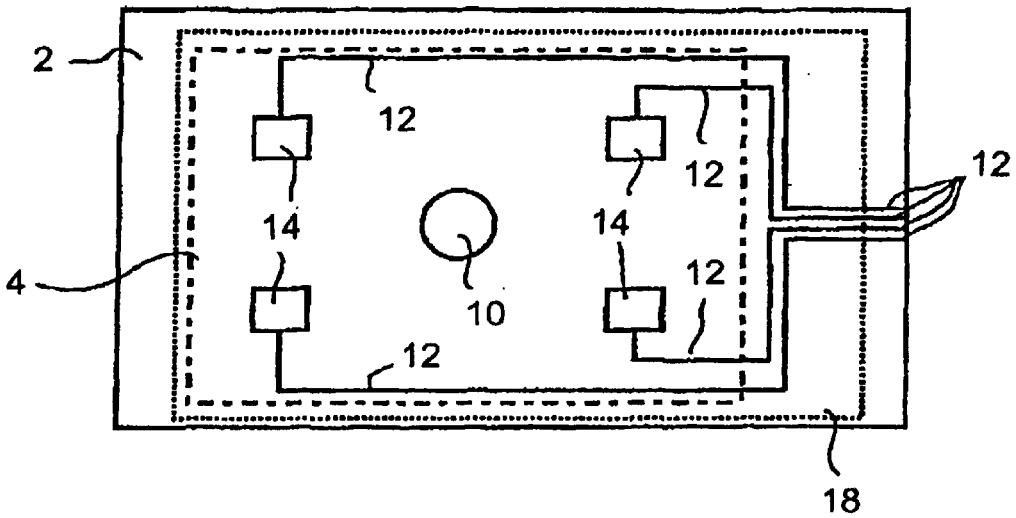
FIG. 1 is a plan view of a support with a number of conductor tracks applied thereon.
Figure 2:
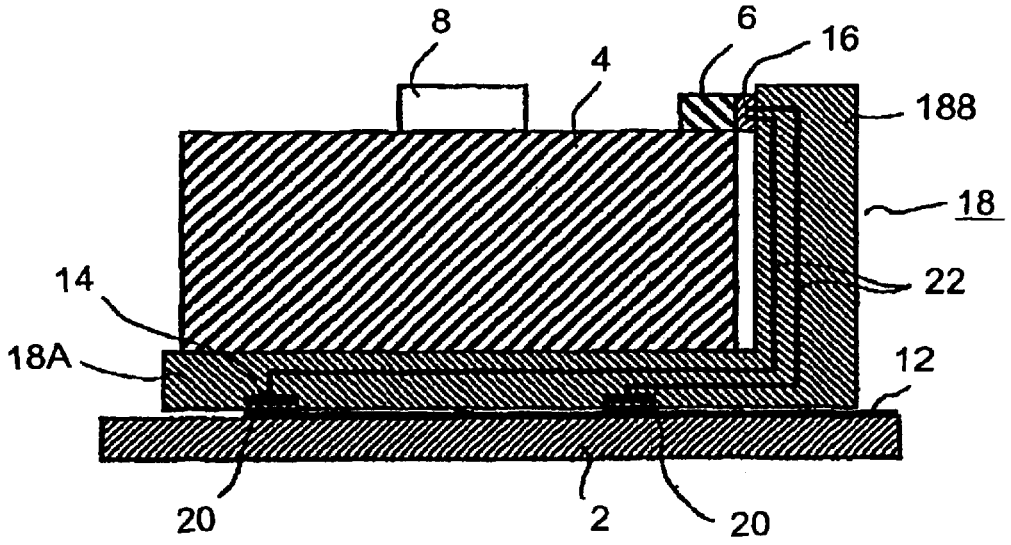
FIG. 2 is a side view of the support of FIG. 1 together with a terminal adapter fitted to it and clamped between an engine block and the support.

Referring now to the figures of the drawing in detail, a block 4 of an engine with an electrical terminal or electrical connection 6 is fixed on a support 2 in the form of a plate. The latter may, in particular, be a load-bearing bodywork component in the engine compartment of a motor vehicle. The connection 6 is used, by way of example, to connect an engine control unit of the block 4 to the vehicle electrical system of the motor vehicle. The engine block 4 is fixed by means of a fixing means, such as a screw or bolt 8 which is screwed into a threaded hole 10 in the support 2.

A total of four conductor tracks 12 which each end at a respective contact area 14 are applied to the surface of the support 2. This contact area 14 is, for example, a widened portion of the conductor track 12. In the exemplary embodiment, the contact areas are formed by large area square contacts. The conductor tracks 12 are applied directly to the support 2 by a thermal spraying process, such as flame spraying. In particular, the conductor tracks 12 and the contact areas 14 are permanently connected to the support 2.

The engine block 4 is designed with a conventional connection terminal 6 which can be connected to the vehicle electrical system by a plug 16 which has, by way of example, contact sockets or contact pins. Contact is made between the connection 6 and the conductor tracks 12 by way of a connection adapter or terminal adapter 18 that has an approximately L-shaped cross section. The basic outlines of the terminal adapter 18 and of the engine block 4 are respectively indicated in FIG. 1 by a dotted line and a dashed-dotted line.

The connection adapter or terminal adapter 18 has a first part 18A which is clamped between the support 2 and the engine block 4. This first part 18A has, on its lower side facing the support 2, terminal contact areas 20 which are pressed against the contact areas 14 by the clamping force of the screw 8 when the engine block 4 is braced, with electrical contact being made as a result. Conductors 22, for example wires, run from the connection contact areas 20 to the plug 16. The conductor tracks 12 are therefore routed in the terminal adapter 18 to the connection 6. In the process, the conductors 22 are routed upward on the side of the engine block 4 to the plug 16 in a second part 18B of the terminal adapter which forms the second limb of the L. The geometry of the terminal adapter depends on where on the engine block 4 the connection 6 is arranged. The individual limbs of the connection adapter 8 expediently bear directly against the engine block 4 in order to ensure space-saving assembly.

In the exemplary embodiment, the terminal adapter 18 is fixed to the support 2 at the same time that the engine block 4 is fixed by the screw 8. Therefore, no separate fixing means are required. This permits simple and quick assembly. A terminal adapter 18 of this type thus makes possible a simple and convenient change of system between the conductor tracks 12 being applied directly to the support 2 and the conventional connection 6, without a large amount of assembly effort. The terminal adapter 18 is therefore particularly suitable in cases where an vehicle electrical system designed according to the novel method for producing the conductor tracks has to be connected to a conventional electrical component.

We claim:

1. A device, comprising:

a support having a surface;

a unit mounted to said support, said unit having a connection terminal;

at least one electrical conductor track applied directly to said surface of said support and having a contact area;

a terminal adapter including at least one conductor and formed with first and second parts, said first part being disposed between said support and said unit in an assembled state and having a surface facing said support, said first part having a terminal contact area of said conductor on said surface facing said support causing said terminal contact area to be in electrical contact with said contact area of said conductor track, and said second part extending laterally along said unit and said conductor being routed in said second part to said connection terminal.

2. The device according to claim 1, wherein said unit is an electrical component of a motor vehicle.

3. The apparatus according to claim 1, wherein electrical contact between said conductor track and said terminal adapter is established by bracing said unit to said support.

4. The apparatus according to claim 3, wherein said conductor track is one of a plurality of conductor tracks formed on said support, and each having an end with a contact area for making electrical contact with said terminal adapter.

5. The apparatus according to claim 1, wherein said terminal adapter is L-shaped in cross section, said first part defining a first limb of an L, and said second part forming a second limb of the L, and said second limb is routed along a side of said unit to said connection terminal thereof.

6. The apparatus according to claim 5, wherein a portion of said terminal adapter defines said L-shaped cross section.

7. The apparatus according to claim 5, wherein the entire said terminal adapter consists of said L-shaped cross section.

8. The apparatus according to claim 1, wherein said conductor track is applied, and adheres, directly to said support.

9. The apparatus according to claim 8, wherein said conductor track thermal-spraying-process track.

10. The apparatus according to claim 1, wherein said support is a load-bearing bodywork component.

11. The apparatus according to claim 10, wherein said support is a load-bearing bodywork component in an engine compartment of a motor vehicle.

12. A connection device for electrically connecting an electrical unit with a first terminal system having a connection terminal to a second terminal system having flat conductor tracks formed directly on a surface of a support, the conductor tracks having contact areas, the connection device comprising:

a terminal adapter having conductors and formed with first and second parts:

said first part being configured for placement, in an assembled state, between the electrical unit and the flat conductor tracks formed on the support, and having terminal contact areas of said conductors on a surface facing the support, said terminal contact areas of said first part making electrical contact with the contact areas of the flat conductor tracks; and said second part adjoining said first part and extending laterally alongside the electrical unit and said conductors being routed in said second part to the connection terminal.

13. The device according to claim 12, wherein said terminal adapter is configured to interconnect a conventional connection terminal of the electrical unit with a flat conductor track system of a motor vehicle.

* * * * *